United States Patent [19]

Singels-Craenen

[11] Patent Number: 4,828,181

[45] Date of Patent: May 9, 1989

[54] AIR-PRESSURE-ATOMIZER

[75] Inventor: Maria M. J. Singels-Craenen, Eindhoven, Netherlands

[73] Assignee: Fluidics Instruments B.V., Eindhoven, Netherlands

[21] Appl. No.: 125,644

[22] Filed: Nov. 25, 1987

[30] Foreign Application Priority Data

Nov. 27, 1986 [EP] European Pat. Off. ..... 86116465

[51] Int. Cl.[4] ..... F23D 11/12

[52] U.S. Cl. ..... 239/405; 239/432

[58] Field of Search ..... 239/403, 405, 408, 416.5, 239/417.3, 417.5, 429, 430, 432, 433, 585

[56] References Cited

U.S. PATENT DOCUMENTS

| | | | |
|---|---|---|---|
| 716,724 | 12/1902 | Lässoe et al. | 239/405 X |
| 1,176,017 | 3/1916 | Armstrong | 239/432 X |
| 1,428,896 | 9/1922 | McDonald et al. | 239/405 |
| 1,430,278 | 9/1922 | Barber et al. | 239/432 |
| 2,072,281 | 3/1937 | Simonin | 239/432 X |
| 2,942,790 | 6/1960 | Starkey | 239/405 |
| 3,782,639 | 1/1974 | Boltz et al. | 239/405 |
| 3,929,290 | 12/1975 | Tallarovic | 239/417.3 |

FOREIGN PATENT DOCUMENTS

| | | |
|---|---|---|
| 0092002 | 10/1983 | European Pat. Off. . |
| 2000280 | 9/1969 | France . |

*Primary Examiner*—Andres Kashnikow

*Attorney, Agent, or Firm*—Pennie & Edmonds

[57] ABSTRACT

Air-pressure-atomizers for liquids, whereby pressurized air and oil are first mixed in one chamber in the atomizer body of the atomizer and the mixture is discharged through an opening in the form of a spray jet. According to the invention, the spinner body (2, 3, 4, 7) of the atomizer (1) has a central dosing bore for oil (3, 4) and near the end of said bore (3) there is centrally symmetrically located a target impact disc or pin (6). The pin extends into a cavity (5) in the direction of the central bore (3). Air supply bores (slots) (7) tangentially open into the cavity (5) in the direction of the space between the dosing bore (3) and the target pin (6). At the other side of the cavity there is at least one outlet opening (8) present for discharging the mixture.

6 Claims, 1 Drawing Sheet

AIR-PRESSURE-ATOMIZER

The invention relates to an air-pressure-atomizer for liquids, whereby pressurized air and oil are first mixed in at least one chamber in the atomizer body and the mixture is discharged through an opening in the form of a spray jet.

These atomizers having internal mixing are used in oil burners for burning oil in ovens, boilers and other heating devices, where discrete regulation of the heating capacity is required or where very small heating capacities are used. Said atomizers are made in various versions; up to now, however, for small capacities as a unit delivering only one spray jet. Said spray jet consists of fine oil particles which have been atomized by the pressurized air. The distribution and the uniformity of the drops thereby depends in particular on the mixing process in the atomizer, the manner in which the oil is put into the air stream, the air pressure, the viscosity of the oil and on the adjustable range of the atomizer respectively.

In this case the spray jet has a scattering angle which is influenced by the amount of atomizing air admitted, which also determines the length of the spray jet. With several spray jets and the same capacity the length will be accordingly smaller and the scattering angle can be varied in accordance with the character of the burner head and the burner. Also, the degree of admission in this case has almost no influence on the scattering angle of the separate spray jets.

The capacity control of the air-pressure-atomizer for small quantities of flow is effected by regulation of the oil pressure, while the air pressure, adjustable between 0.5 and 1 Bar, remains practically constant.

Such an air-pressure-atomizer is known from EPO No. 0,092,002. However, this atomizer has the disadvantage that its construction is rather complicated. With this and other known mixing systems in the atomizer the quantity regulation is often problematic if oil enters the vortex chamber practically without pressure.

The purpose of the present invention is to remove the above disadvantages by means of a simple construction.

The invention is characterized in that the body of the atomizer has a central dosing bore for oil. Near the end of the bore there is centrally and symmetrically located a target impact disc or pin which extends into a cavity in the direction of the central bore. Air supply bores (slots) tangentially open into this cavity in the direction of the space between the dosing bore and the target impact pin, at the other side of the cavity there is at least one opening present for discharging a mixture of oil and air.

The purpose of the invention of the air-pressure-atomizer having the central injection system and circular vortex channel is to obtain a more intensive mixing of air and oil, making the atomization of the oil through several outlet bores possible. The result of this is that much better combustion results and adjusting ranges can be achieved. Besides the simple construction the following advantages can be mentioned:

1. The air-pressure-atomizer with the circular vortex channel formed by the construction provides a very intensive mixing of air and oil. Because of the impact effect a very thin oil film is produced which is taken along, mixed and homogenized by the whirling air flow in the circular vortex channel.

2. Because of the circular vortex channel it is possible to provide the atomizer with several outlet bores, as a result of which a better distribution of the mixture takes place and thus a better combustion is achieved.
3. The outlet bores can be provided at any desired angles, as a result of which all scattering angles are possible and a complete adjustment to all types of burner heads is ensured.
4. The intensive mixing allows a large capacity control and even at 1/10 of the load the atomizing remains stable and uniform.
5. Because of the central injection system it is possible to provide the atomizer with a closing needle in the central dosing bore, as a result of which the oil flow in the atomizer can be interrupted quickly and at will.

The target impact pin or disc preferably has tangential slots in the direction of the tangential air supply slots, in order that the efficiency of the mixing of the oil and the air is further improved.

The invention will be explained with reference to a drawing, in which.

Figure 1:
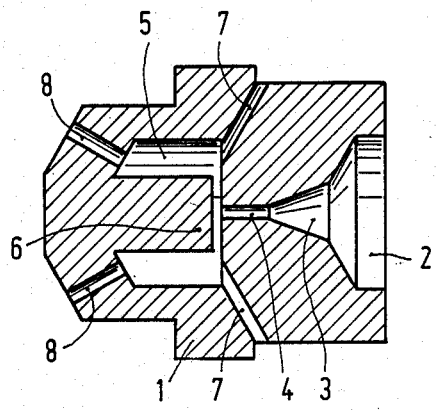
FIG. 1 is a simple sectional view of the atomizer head.
Figure 2:
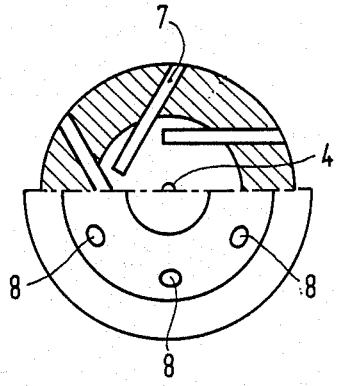
FIG. 2 is a section perpendicular to the one of FIG. 1.

In the FIGS. 1 and 2 the head is indicated by 1. The oil connection 2 has a narrowing part 3 extending as far as the central dosing bore 4. In a cylindrical cavity 5 there is present a cylindrical target impact pin (or disc) 6, centrally opposite the dosing bore 4. the cavity 5 is in the shape of a cylinder with the cylindrical impact pin forming a solid core in the cylindrical cavity. Oil supplied strikes against the the flat end of the cylindrical impact pin 6 and is radially scattered to all sides as a thin film. At this spot pressurized air is tangentially supplied through bores 7 in the direction of the narrow space separating the cylindrical impact pin 6 and the dosing bore 4. The thin oil film is homogeneously mixed with air supplied through the bores 7. Said homogeneous mixture of oil and air is atomized through one or more outlet bores 8. As previously described, this atomizing can be adjusted at will.

Figure 3:
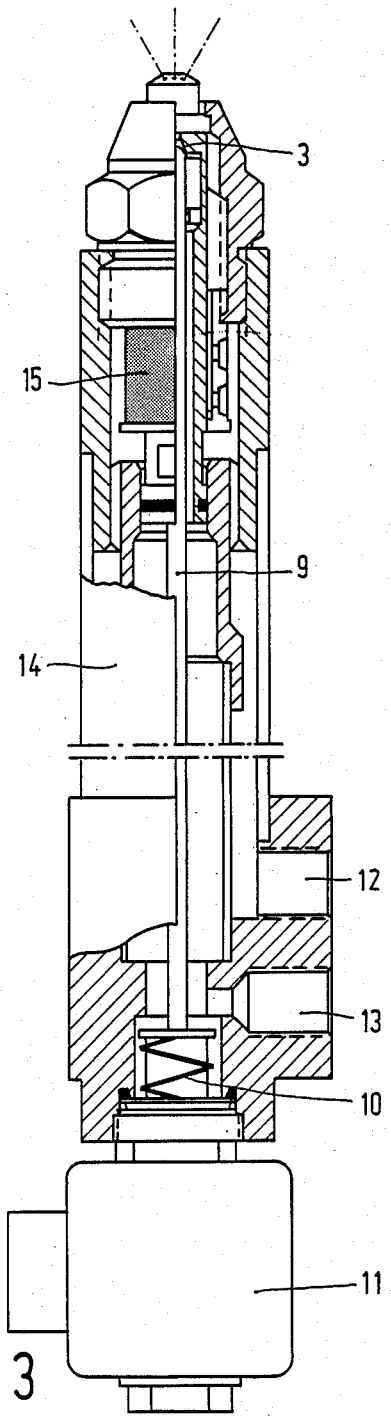
FIG. 3 is a section of the complete atomizer set.

FIG. 3 shows the entire atomizer set 14 with the linkage. Centrally in the bore there is located a closing needle 9, which at its free end co-operates with the narrowing oil supply part 3 which forms a seat for the closing needle 9. A coil spring 10 keeps the opening 3 closed. By exciting the electromagnet 11 the opening 3 and with it the oil supply can be opened abruptly. The pressurized air supply has a connection 12, and the oil supply has a connection 13. In the channel between the connection 12 and the channels 3 and 2 there is located, still inside the housing of the atomizer set 14, an air filter 15.

I claim:

1. Air-pressure-atomizer for liquids, whereby pressurized air and oil are first mixed in one chamber in the atomizer body of the atomizer and the mixture is discharged in the form of a spray jet, characterized in that the atomizer includes a spinner body (2, 3, 4, 7) with a central dosing bore (3, 4) for oil and spaced near the end of said bore (3) there is centrally symmetrically located a cylindrical target inpact pin (6), said cylindrical pin extending in the direction of the central bore (3), to form the solid core of a cylindrical cavity (5) into which air supply bores (7) tangentially open at an end of the cylindrical cavity (5) between the dosing bore (3) and the cylindrical impact pin (6), and at the other end of the cylindrical cavity (5) there is at least one outlet opening (8) present for discharging a mixture of oil and air.

2. Air-pressure-atomizer for liquids, wherein pressurized air and oil are first mixed in a chamber in the atomizer and the mixture is discharged in the form of a spray jet, characterized in that the atomizer includes a head (1) defining a central dosing bore (4) and a cylindrical cavity (5) communicating with the dosing bore (4) by means of a narrow space, a cylindrical target impact pin (6) extending from the head (1) opposite the central dosing bore (4) into the cylindrical cavity (5) to form the solid core of the cylindrical cavity (5) and providing a flat surface for oil exiting the dosing bore (4) to strike, at least one air supply bore (7) defined by the head (1) opening tangentially into the cylindrical cavity (5), and at least one outlet opening (8) defined by the head (1) opposite the air supply bore (7) for discharging the air and oil mixture from the cylindrical cavity (5).

3. Air-pressure-atomizer according to either of claims 1 and 2, characterized in that the atomizer further includes a movable closing needle (9) and a seat in the oil supply bore (3) which is narrowing, said needle being movable toward said seat to reduce or shut off the oil supply said needle being movable toward and away from said seat by means of a coil spring (1) and an electromagnet (11).

4. Air-pressure-atomizer according to claim 1, characterized in that the cylindrical impact pin (6) is provided with a slot surface closely spaced adjacent to said dosing bore.

5. Air-pressure-atomizer according to claim 1 or 2, characterized in that said air supply bores (7) are arranged obliquely relative to the central axis of said cylindrical cavity (5) such that the mixture is provided with an additional velocity component in the direction of said outlet opening (8).

6. Air-pressure-atomizer according to claim 1 or 2, characterized in that said outlet opening (8) extends radially outward relative to the central axis of the cylindrical target impact pin (6).

* * * * *